US011583101B2

(12) United States Patent
Gladney et al.

(10) Patent No.: US 11,583,101 B2
(45) **Date of Patent: *Feb. 21, 2023**

(54) MATTRESS OR MATTRESS PAD WITH GEL SECTION

(75) Inventors: Richard F. Gladney, Fairburn, GA (US); Corey Westerman, Newnan, GA (US); Michael S. DeFranks, Decatur, GA (US)

(73) Assignee: DREAMWELL, LTD., Doraville, GA (US)

( * ) Notice: Subject to any disclaimer, the term of this patent is extended or adjusted under 35 U.S.C. 154(b) by 114 days.

This patent is subject to a terminal disclaimer.

(21) Appl. No.: 13/354,571

(22) Filed: Jan. 20, 2012

(65) Prior Publication Data

US 2012/0180225 A1 Jul. 19, 2012

Related U.S. Application Data

(63) Continuation of application No. 11/922,739, filed as application No. PCT/US2007/008419 on Apr. 3, 2007, now Pat. No. 8,307,482, and a continuation of application No. 11/397,206, filed on Apr. 3, 2006, now abandoned.

(51) Int. Cl.

| | |
|---|---|
| ***A47C 27/14*** | (2006.01) |
| ***A47C 27/20*** | (2006.01) |
| ***A47C 27/15*** | (2006.01) |

(52) U.S. Cl.

CPC ..... *A47C 27/148* (2013.01); *A47C 27/15* (2013.01); *A47C 27/20* (2013.01); *Y10T 156/1039* (2015.01)

(58) Field of Classification Search

CPC ..... A47C 27/14; A47C 27/142; A47C 27/144; A47C 27/146; A47C 27/148; A47C 27/15; A47C 27/16; A47C 27/18; A47C 27/20; Y10T 156/1039

USPC ..... 5/727, 909, 644, 728, 655.5

See application file for complete search history.

(56) References Cited

U.S. PATENT DOCUMENTS

| | | | | |
|---|---|---|---|---|
| 672,904 A | | 4/1901 | Hucklebury | |
| 2,838,771 A | * | 6/1958 | Goodman | A47C 27/127 5/309 |
| 3,308,491 A | * | 3/1967 | Spence | 5/676 |
| 4,504,991 A | | 3/1985 | Klancnik | |
| 5,077,849 A | * | 1/1992 | Farley | 5/730 |
| 5,107,558 A | * | 4/1992 | Luck | 5/727 |
| 5,231,717 A | * | 8/1993 | Scott et al. | 5/727 |
| 5,277,915 A | * | 1/1994 | Provonchee et al. | 424/485 |

(Continued)

FOREIGN PATENT DOCUMENTS

| | | |
|---|---|---|
| CN | 1193282 A | 9/1998 |
| CN | 2698321 Y | 5/2005 |

(Continued)

OTHER PUBLICATIONS

Wikipedia, "Polyurethane", Aug. 3, 2020, https://en.wikipedia.org/wiki/Polyurethane (Year: 2020).*

(Continued)

*Primary Examiner* — Myles A Throop

(74) *Attorney, Agent, or Firm* — Cantor Colburn LLP

(57) ABSTRACT

A mattress or a mattress pad with one or more gel sections. The gel section may provide improved support and comfort at a localized area of a mattress or a mattress pad.

2 Claims, 8 Drawing Sheets

(56) References Cited

U.S. PATENT DOCUMENTS 5,362,834 A * 11/1994 Schapel ..... C08G 18/4816 528/58
5,513,402 A * 5/1996 Schwartz ..... A47C 23/00 5/691
5,633,286 A * 5/1997 Chen ..... 524/474
5,636,395 A 6/1997 Serda
5,678,266 A * 10/1997 Petringa et al. ..... 5/655.5
5,768,251 A 6/1998 Ito et al.
5,819,349 A * 10/1998 Schwartz ..... A47C 27/001 5/722
5,963,998 A * 10/1999 Carew et al. ..... 5/655
6,041,459 A * 3/2000 Nunez et al. ..... 5/730
6,192,538 B1 * 2/2001 Fogel ..... A47C 27/001 5/685
6,230,351 B1 * 5/2001 Kohnle ..... A47C 27/148 5/648
6,343,839 B1 2/2002 Simons, Jr. et al.
6,629,728 B2 10/2003 Losio et al.
6,701,556 B2 3/2004 Romano et al.
6,739,008 B1 * 5/2004 Kindrick ..... A47C 7/021 5/655.9
6,762,243 B2 7/2004 Stender et al.
6,809,143 B2 10/2004 Nowak et al.
6,908,979 B2 6/2005 Arendoski
8,997,279 B1 * 4/2015 McKay ..... A47C 23/002 5/423
2001/0018466 A1 8/2001 Gansen et al.
2001/0056129 A1 12/2001 Stender et al.
2002/0112291 A1 * 8/2002 Barman ..... A47C 21/026 5/716
2003/0106157 A1 * 6/2003 Rugset ..... A47C 31/10 5/738
2003/0109908 A1 * 6/2003 Lachenbruch ..... A47C 21/046 607/96
2003/0135930 A1 * 7/2003 Varese et al. ..... 5/727
2003/0177584 A1 * 9/2003 Boyd ..... 5/727
2004/0074007 A1 * 4/2004 Gladney ..... A47C 27/20 5/727
2004/0098806 A1 5/2004 Stender et al.
2004/0147707 A1 * 7/2004 Arendoski ..... C08G 18/165 528/58
2004/0211005 A1 * 10/2004 Kuo ..... 5/655.5
2005/0097676 A1 * 5/2005 Rensink ..... A47C 27/001 5/721
2006/0288490 A1 * 12/2006 Mikkelsen ..... A47C 7/742 5/740
2007/0067916 A1 * 3/2007 Poston ..... A47C 21/022 5/691
2007/0113352 A1 * 5/2007 Poulos ..... 5/727
2009/0029147 A1 * 1/2009 Tang et al. ..... 428/319.1

FOREIGN PATENT DOCUMENTS

EP 0465810 1/1992
EP 04650810 B1 9/1994
EP 1421878 B1 5/2004
JP H04242607 A 8/1992
JP H1015959 A 1/1998
JP 11009395 A 1/1999
JP 3507385 B2 7/2001
TW 592173 U 6/2004
WO WO1999/058027 A 11/1999
WO WO-2008012209 A2 * 1/2008 ..... H01L 23/4093

OTHER PUBLICATIONS

Dreamwell, Ltd, AU Office Action for AU Application No. 2007235424 dated Oct. 13, 2011; 2 pages.
International Search Report for International Application No. PCT/US2007/008419 dated Sep. 7, 2007; 4 pages.
Written Opinion for International Application No. PCT/US2007008419 dated Sep. 7, 2007; 5 pages.
Office Action issued in Canadian Patent Application No. 2,648,272 dated Jul. 8, 2013; 2 pages.
Office Action issued in Chinese Patent Application No. 200780019489.5, dated Aug. 8, 2014; 18 pages (included Summarized English Translation).
"Aerogel." Wikepdedia, The Free Encyclopedia—http://en.wikipedia.org/wiki/Aerogel. Published on Dec. 31, 2012; 9 pages.
Office Action and Office Action Summary, issued in Korean Patent Application No. 10-2008-7026865, dated Jan. 23, 2014; 5 pages.
Office Action and English Summary of Office Action, issued in Korean Patent Application No. 10-2013-7022639 dated Nov. 22, 2013; 6 pages.
English Abstract of Japanese Publication No. JP-H04242607 A, published on Aug. 31, 1992, 2 pages.
Office Action and English Translation of Office Action, issued in Chinese Patent Application No. 200780019489.5, dated Jun. 15, 2015; 7 pages.
Office Action issued in Chinese Patent Application No. 200780019489.5, dated Aug. 8, 2014; 18 pages (including English Summarized Translation).
Office Action issued in Chinese Patent Application No. 200780019489.5, dated Jan. 26, 2015; 6 pages (including English Summarized Translation).

* cited by examiner

MATTRESS OR MATTRESS PAD WITH GEL SECTION

CROSS REFERENCE TO RELATED APPLICATIONS

This is a U.S. national stage of application No. PCT/EP2007/057198, filed on 3 Apr. 2007, which is a continuation in part application of U.S. application Ser. No. 11/397,206, filed on Apr. 3, 2006, the disclosures of which is also incorporated herein by reference.

BACKGROUND

One of the challenges in the mattress industry is creating a mattress that provides comfortable support to all portions of a human body. Due to the unequal distribution of weight along a human body, its contours, and an individual's preferred sleeping position, e.g., side or back, a mattress surface formed from a core of inner springs may sometimes create localized pressure points in some areas, such as shoulders and hips, while lacking support at other areas, such as the back One solution has been the development of mattresses pads incorporating a combination of gel and padding, such as foam, layers. Typically the gel/padding mattress pad is a removable and replaceable pad made from a layer of gel sandwiched between two layers of foam or a layer of gel is positioned on top of, or below, a foam layer. The gel layer may be formed from one or more polymer bladders filled with a viscous gel material. Typically, the gel layer extends over the entire width and length of the mattress pad, and conforms to the contours of a body to provide support.

However, these mattress pads have several disadvantages, among them the amount of gel material necessary to manufacture a mattress pad and the weight of such a pad. For example, a gel mattress pad for use with a king size mattress may weigh up to 130 pounds. In addition, the weight and flexibility of a gel/foam pad may make it difficult to properly position and/or reposition the pad over a mattress.

Accordingly, there is a need in the art for an improved mattress and/or mattress pad with reduced weight and increased maneuverability.

SUMMARY OF THE INVENTION

The systems and methods described herein include improved gel-based mattresses, mattress toppers and methods for manufacturing the same. More particularly, the mattresses and manufacturing methods described herein include mattresses that have a core or one or more layers typically made of foam integrated with thermosetting material such as gel-type elastomers. In one aspect, the systems and methods include mattress that have an upper support layer typically made of from, latex, visco-elastic foam or some other suitable material. The upper support layer includes channels that are filled with a gel material and covered with a thin film layer. In one particular embodiment, the upper support layer comprises a mattress topper including a padding layer of convoluted polyurethane foam having a channel extending across the width of the foam and positioned along the length of the padding layer at a location that would be proximate to the shoulders of a reposed user. The actual location, size and geometry of the gel filled channel can vary, as can the number of such gel filled channels integrated into the topper, and the actual size, location, geometry and number employed will vary according to the application and use of the mattress.

Another aspect of the invention provides a manufacturing process that forms the upper support layer through a process that pours the gel in a liquid form into the channel. The liquid gel is allowed to cure into a soft, resilient solid material. The gel can adhere to the bottom of the channel to securely join to the upper support layer. In an optional step, a thin plastic film may be laid over the cured gel.

Additionally the methods described herein provide reduce the amount of gel material required to make a gel mattress, topper or pad and consequently, reduce the weight of the product. In addition, cost savings are realized due to the decreased use of gel material. Additional advantages of the gel/padding combination cushion are its increased maneuverability and reduced weight compared to a cushion of the same size made almost completely of gel material.

According to one aspect of the invention, the gel section is positioned on a cushion, a mattress or a mattress pad at a location subject to frequent use. For example, a large bed, such as a king- or queen-size bed, may have two frequently used locations side by side.

In one aspect of the invention, a mattress pad includes a cushion layer covered with a sheet of fabric. The exterior of the mattress pad may have a quilted pattern. The cushion layer may be formed from a padding section and a gel section. The padding section forms the periphery of the cushion layer and includes an aperture. A gel material is poured into the aperture and allowed to cure. The cured gel section may be bonded to the padding section. The top surface of the gel section may be substantially flush with the top surface of the padding section so that the cushion layer has a substantially flat top surface. Likewise, the bottom surface of the gel section may be substantially flush with the bottom-surface of the padding section.

According to another embodiment, one, or both, of the top and bottom surfaces of the gel section may be uneven with the respective top and bottom surfaces of the padding section, for example, lower than the top surface of the padding section. Additional padding material may be placed on top of the gel section to form a substantially level cushion layer.

According to another embodiment, the padding section may include two or more 15 channels with gel cured within each aperture.

According to another embodiment, the gel section may be formed from a stable, nonflowing gel. In other embodiments, the gel section may be formed from a liquid gel, a foam gel, a visco-elastic gel, or a combination thereof. In yet another embodiment, the gel section may be formed from a gel-filled bladder. In another embodiment, the gel section may be puncture resistant and/or leak proof. Suitable gels may include silicone gel, PVC gel, polyorganosiloxane gel, NCO-prepolymer gel, polyol gel, polyurethane gel, polyisocyanate gel, and gel including a pyrogenically produced oxide.

In another aspect, the systems and methods described herein include mattress assemblies having one or more mattress components such as a mattress core and/or a support layer. The mattress assemblies include a porous polyurethane body, having a plurality of air pockets non-uniformly distributed within the body and filled, at least in part, with a thermoset elastomer. In certain embodiments, the porous polyurethane body includes at least one of foam, latex, visco-elastic foam, plastic, polymer, and natural fiber. In other aspects, the mattress assemblies include a body having a porous polyurethane cell structure infused with an elastomer such that the elastomer fills a plurality of air pockets in the body and bonds with the porous polyurethane cell structure. In still other aspects, the mattress assemblies include a porous polyurethane cell structure having a plurality of air pockets, and a liquid elastomer disposed within the plurality of air pockets and bonded with the porous polyurethane cell structure.

In certain aspects, the systems and methods described herein include methods for manufacturing mattresses, mattress assemblies and mattress components comprising providing a porous polyurethane slab for use with a mattress component and having a plurality of air pockets. The methods further include combining the porous polyurethane slab with a liquid elastomer, such that the liquid elastomer fills at least in part the plurality of air pockets, and hardening the liquid elastomer to form the mattress component having portions of the porous polyurethane slab intermixed with portions of the hardened liquid elastomer. In certain embodiments, combining the porous polyurethane slab with the liquid elastomer includes pouring the liquid elastomer over the porous polyurethane slab. In certain embodiments, combining the porous polyurethane slab with the liquid elastomer includes dipping the porous polyurethane slab in a volume of the liquid elastomer In certain embodiments, the porous polyurethane slab includes a reticulated polyurethane slab and providing a reticulated polyurethane slab includes generating a plurality of air pockets in the porous polyurethane slab. The plurality of air pockets may be generated by applying a caustic solution to a portion of the porous polyurethane slab. In certain embodiments, the air pockets may be generated by combining the porous polyurethane slab with an explosive gas such as hydrogen or oxygen, and igniting the explosive gas to generate the plurality of air pockets within the porous polyurethane slab. In such embodiments, the porous polyurethane slab is passed through a chamber having the explosive gas. In certain embodiments, combining the reticulated polyurethane slab with the liquid elastomer includes pouring the liquid elastomer over the reticulated polyurethane slab.

The foregoing and other objects, features, and advantages of the invention will become more apparent from the following description and from the claims.

BRIEF DESCRIPTION OF THE DRAWINGS

Various illustrative systems, methods, devices, features and advantages of the invention are described below with reference to the appended drawings, which may not be drawn to scale and in which like parts are designated by like reference designations.

DESCRIPTION OF ILLUSTRATIVE EMBODIMENTS

Referring now to the figures, in which like numerals designate like elements throughout, the several views provided by the provided Figures illustrate various embodiments of the present invention. However, the embodiments illustrated and discussed herein are presented for the purpose of enabling one to make and use the invention described herein and is not exhaustive and should not be understood as limiting in any way.

As described in summary above, in various illustrative embodiments, the systems and methods described herein are directed to mattresses and manufacturing methods for mattresses that have a core or one or more layers typically made of foam integrated with thermosetting material such as gel-type elastomers. In certain aspects, as illustrated in FIGS. 1A-4 the systems and methods include a mattress with a topper that has a section of gel at a location predicted to be typically or frequently used. The invention further includes manufacturing processes during which a liquid gel material is poured into a channel or cavity within a support layer and cured in place to provide a soft solid gel material that is integrally formed within the support layer. In other aspects, as illustrated in FIGS. 5-8, a porous foam body and gel are intermixed within the body such that the gel occupies portions air pockets within the porous foam. The systems and methods further include manufacturing processes during which liquid gel is allowed to fill air pockets within a foam body and cured to provide a mattress core or support layer having advantageous properties of the foam as well as the gel.

Figure 1A:
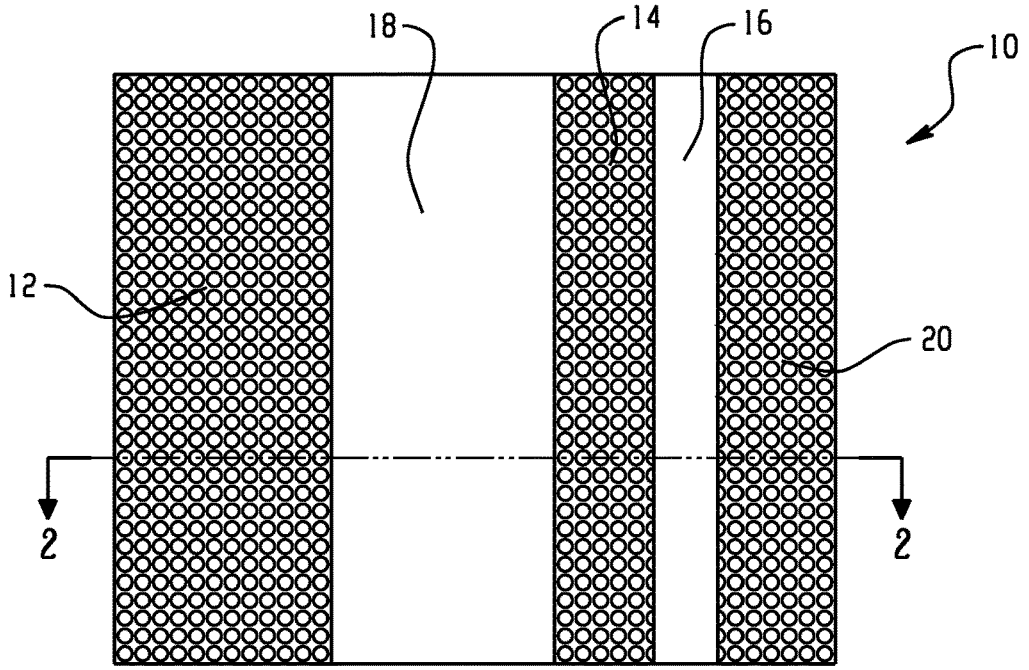
FIGS. 1A and 1B depict one embodiment of a mattress pad with a gel layer according to the invention.
Figure 1B:
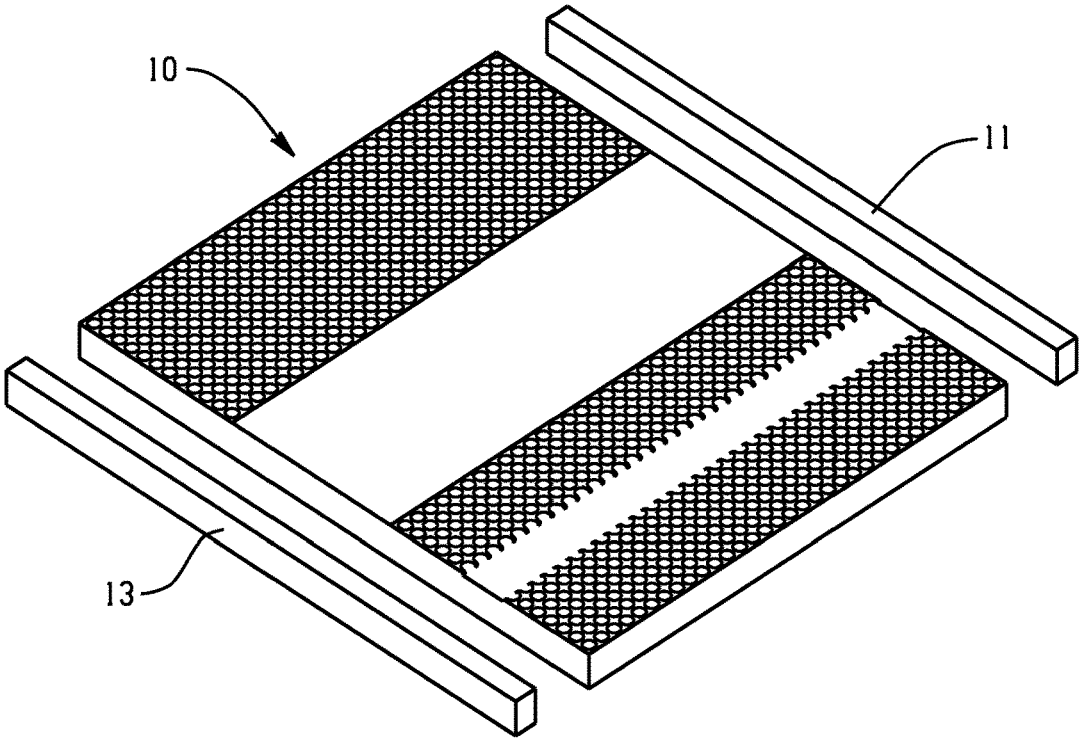

FIGS. 1A and 1B depict a first embodiment of a mattress support layer having a gel section positioned in the area generally adjacent to where a person's lumbar region would be when lying on the mattress for rest and/or sleeping. Specifically, FIG. 1A depicts an embodiment of the mattress support layer 10 having a padding section 12, and a first gel section 18. As illustrated, the mattress support layer 10 is made with one gel section, however, it will be understood that a mattress support may have multiple gel sections and the sections may be sized and shaped differently depending on the area of the body being supported as well as the size of the mattress. For example, a queen-size mattress may have one size gel section and a king size mattress may have a larger gel section or additional gel sections. For purposes of clarity, the support layer 10 shown in FIGS. 1A and 1B is presented without a fabric covering. However, it will be understood that the mattress support layer 10 may be covered with one or more layers of fabric, and an optional removable cover. Further, it will be understood that the support layer 10 is presented as separate from a mattress assembly but that in use, the mattress support layer 10 may be attached to a mattress assembly as a mattress topper, and upper sleeping layer disposed directly above the mattress core, or as a removable mattress pad. Further, although the systems and methods described herein are drawn to mattress &d mattress toppers, it will be understood by those of skill in the art that other cushions and furniture may employ the invention without departing from the scope hereof. For example, the systems and methods of the invention may be used to provide futon mattresses, seat cushions, including automotive seat cushions, sofa cushions, pillows and other such cushions and supports.

More particularly, FIG. 1A depicts a plane eye view of one embodiment of a mattress topper that includes a section of gel material located at the lumbar region. The depicted mattress topper is of the type that may be laid on the upper surface of a mattress and covered with a casing of upholstery for providing a proper aesthetic appearance. The topper may be joined by stitching, zipper or some other mechanism to the upper upholstered surface of the mattress to provide an additional layer of support.

In particular, FIG. 1A depicts an upper support layer 10 that includes five zones formed within a layer of convoluted foam. In the depicted embodiment, the upper support layer 10 includes a zone 12 of convoluted foam that would support the neck and shoulders, a zone 14 is positioned to support the hip region, zone 16 is positioned in the region of the upper legs, and a zone 20 is positioned in the region of the lower legs. In the depicted embodiment, the lumbar region 18 includes a layer of soft resilient gel material. The lumbar zone 18 extends substantially across the width of the support layer 10 and is approximately 9 inches wide and sized for use with a standard queen sized mattress.

Turning to FIG. 1B, it can be seen that in one embodiment, the upper support layer 10 comprises a layer of convoluted foam that has the egg crate structure across regions 12, 14 and 20. A smooth foam section is provided at region 16 and the gel material is positioned at lumbar region 18. In one embodiment the convoluted foam of upper support layer 10 is formed during a convolution process to have a channel cut one-half inch deep into the surface of the support layer 10. The one-half inch deep channel of region 18 provides a recess into which the gel material may be placed. As will be described in more detail below, in one process the gel material is poured into the one-half inch recess while the gel material is in a liquid form. The liquid gel is then allowed to cure until it becomes a soft resilient gelatinous material that is somewhat tacky to the touch. During the curing process, the liquid gel may adhere to the convoluted foam, which may be polyurethane foam, and thereby secure itself within the recess. In other embodiments, the channel may have a depth ranging from about one-quarter of an inch up to about four inches or more. For example, the channel may be about one-quarter of an inch deep, three-quarters of an inch deep, one-inch deep, two inches deep, three inches deep, four inches deep, or any depth in between.

The upper support layer 10 may be polyurethane foam, latex, visco-elastic foam or some other suitable material. In one embodiment, the support layer 10 is polyurethane foam that has been shaped by a programmable convoluting machine that forms the egg crate surface as well as the recessed channel by cutting away sections of a foam block. The use of such foam convoluting machines will be known to those of skill in the art. In one practice the convoluting machine cuts a channel into the foam block at lumbar region 18, such that the channel extends fully from one side of the mattress to the other. The perimeter of the region 18 is illustrated as having a rectangular shape, but it may be any suitable shape such as oval, square, humanoid or any other shape, regular or irregular.

To facilitate this pouring and curing process, FIG. 1B depicts that the convoluted foam pad 10 may be joined to two side rails 11 and 13 each extending in the depicted embodiment along the full length of the upper support layer 10. In the embodiment depicted in FIG. 1B the channel that is formed within the convoluted foam extends fully from one side of the foam layer to the other side. The depicted foam rails 11 and 13 butt up against and are adhered to the sides of the support layer 10 thereby providing sidewalls for the one-half inch deep channel that is formed within the support layer 10. These side rails 11 and 13 will act to maintain the liquid gel within the channel. In addition, the side rails 11 and 13 can serve as work surfaces along the edges of the support layer 10. For example, padding or other materials can be stitched, or otherwise attached, to the side rails 11 and 13, thereby avoiding piercing or otherwise damaging the gel section.

The side rails 11 and 13 may be polyurethane foam and they may be glued to the sides of the support layer 10. In the depicted embodiment the side rails 11 and 13 extend along the 11 length of the support pad 10. However in optional alternative embodiments, the side rails 11 and 13 may be replaced by smaller side walls that can be fit into the channel cut within the foam and positioned at either end of the channel to act as dams that prevent the liquid gel from spilling out of the channel as it is being poured in place. Further, in another optional embodiment, the channel formed within the support layer 10 may be positioned between the extreme ends of the support layer 10 such that each end of the channel is closed by the remaining foam material which provides a sidewall that prevents the liquid gel material from spilling from the channel. The recessed channel in the support layer 10 may be formed by a convoluter or a foam router cutting a block of foam or by any other suitable technique, such as by molding or extruding material. The technique employed may depend upon the geometry of the cut as well as the material being cut.

In the embodiment depicted in FIGS. 1A and 1B the channel formed in region 18 is filled with unpackaged gel material to a height that brings the gel material level height of the other zones of the support layer 10. This provides for a more even upper support surface and greater user comfort.

In an optional alternative embodiment, the gel may be contained in a pouch or bag and fitted into the channel recess formed in the upper support layer 10. The packaged gel can fit into and abut against the inner perimeter of the channel recess at section 18 and may be fiction fitted to or bonded to the inner sidewall and bottom wall of the channel recess by for example, heat sealing, sewing, gluing, tying, stapling, or other method known in the art.

The unpackaged gel section may be formed from a liquid or solid gel. The unpackaged gel section may be formed by pouring the liquid gel into the channel recess or by cutting a gel section from a block of dimensionally stable, resilient gel. Alternatively, the gel may be molded or extruded into the desired shape. In an alternate embodiment, a packaged gel section may be formed from a bladder filled with a viscous gel. The bladder may be formed, for example, by sealing the edges of two sheets of flexible plastic together to form the desired shape. Alternatively, the gel section may be formed from a foam gel, or a combination of a liquid, solid, and/or foam gel. Suitable gels include silicone gels, PVC gels, polyorganosiloxane gels, NCO-prepolyrner gels, polyol gels, polyurethane gels, polyisocyanate gels, and gels including one or more pyrogenically produced oxides. Preferably, the gel is dimensionally stable.

In still a further embodiment, the gel may be placed into the mattress in two steps. In a first step a block of dimensionally stable gel is laid into the channel recess such that there is a gap between the sides of the gel block and the inner side wall of the recessed channel. In a second step, liquid gel may be poured into the recessed channel, optionally over the block, to adhere the gel block to the foam support layer.

Figure 2:
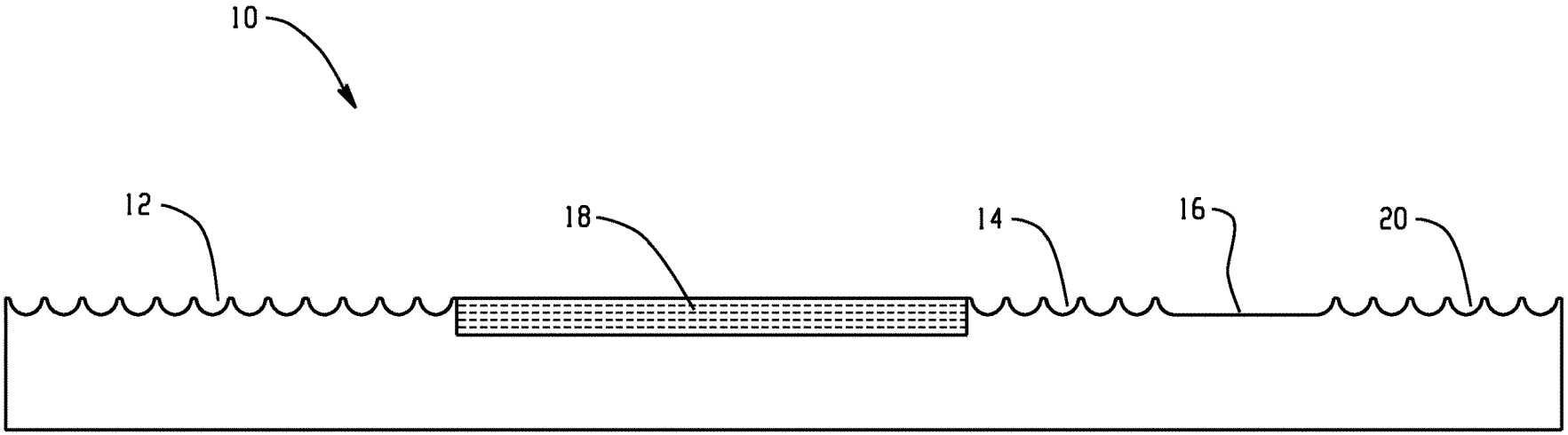
FIG. 2 depicts a cross-sectional view of the mattress pad of FIG. 1.

FIG. 2 depicts a cross-sectional view of the mattress pad of FIG. 1 along line 2-2'. As illustrated in FIG. 2, the top surfaces of the gel section 18 and padding section 12 are substantially flush relative to each other, and the foam padding extends under the gel section and provides a bottom wall upon which the gel material can sit and adhere. However, in other embodiments, the surfaces of the gel section 18 may be higher or lower than the surfaces of the padding section 12.

Figure 3:
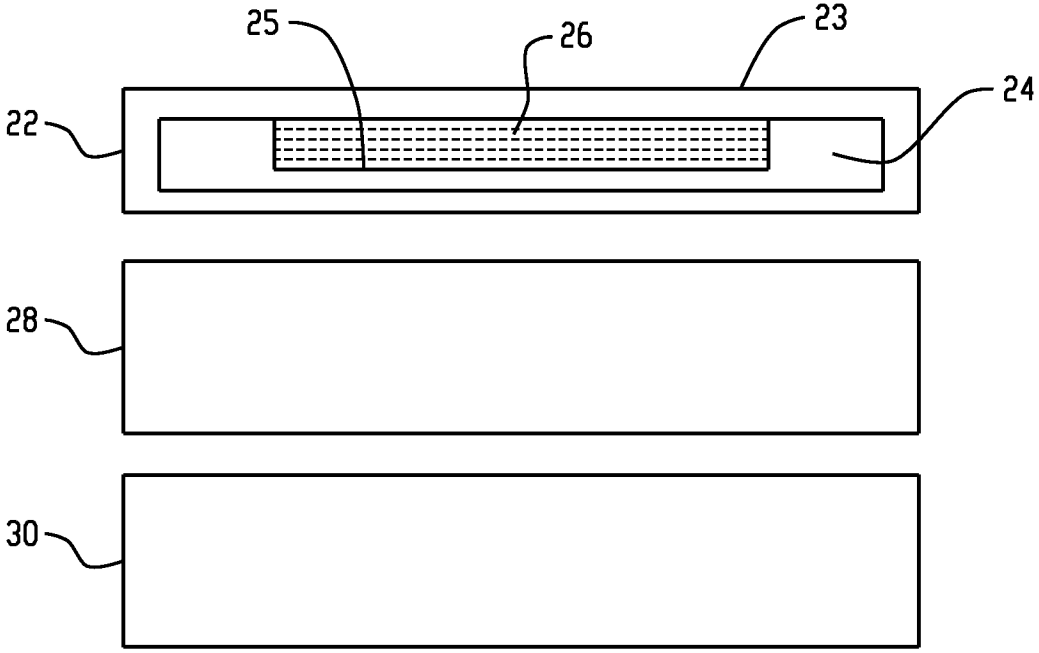
FIG. 3 depicts a cross-sectional view of another embodiment of a mattress pad according to the present invention positioned atop a mattress and foundation.

FIG. 3 depicts a cross-sectional view of another embodiment of a mattress pad 22 according to the present invention positioned atop a mattress 28 and foundation 30. The mattress pad 22 comprises a padding section 24 and a gel section 26 enclosed in a cover 23. Cover 23 may be removable or permanently joined to the padding and gel sections.

In this embodiment, padding section 24 includes a recess 25. Similar to mattress pad 10, gel section 26 fits into recess 25. The padding section 24 and recess 25 may be formed as described above or by bonding two layers of padding material, one layer including an aperture and one complete layer. The height of the padding section may be from about 1.5 to about 6 inches, with the recess 25 being from about 1 to about 4 inches in height. The length and width of the padding section and the dimensions of the gel section remain as described above.

Figure 4:
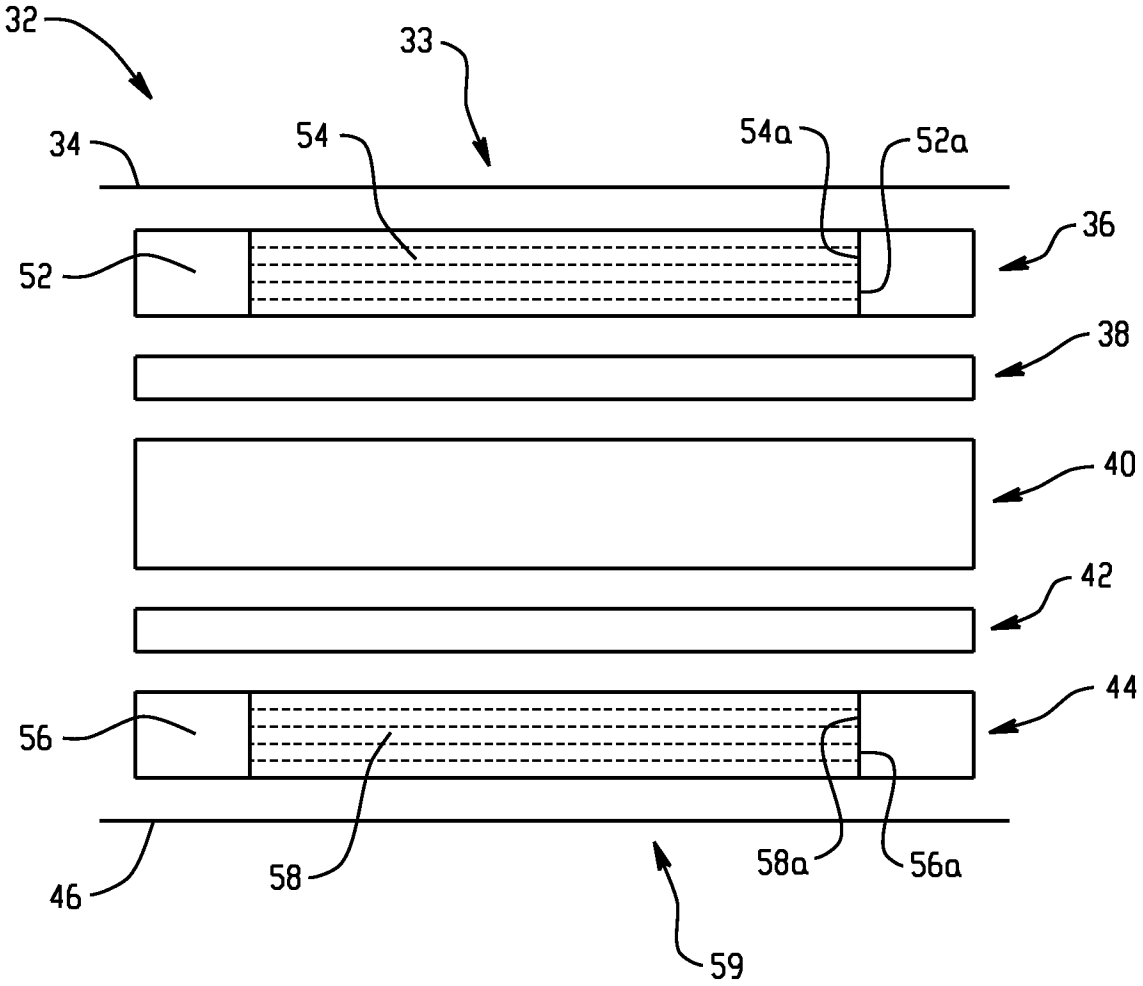
FIG. 4 depicts a cross-sectional view of one embodiment of a mattress with a gel layer according to the present invention.

FIG. 4 depicts a cross-sectional view of one embodiment of a mattress with two cushion layers according to the present invention. Mattress 32 includes several layers on top of a mattress core 40 to form a first sleep surface 33 and several layers beneath a mattress core 40 to form a second sleep surface 59. The first sleep surface 33 has a fabric layer 34, a cushion layer 36, and a pad layer 38 on top of mattress core 40. When flipped over, the second sleep surface 59 has a fabric layer 46, a cushion layer 44, and a pad layer 42 on top of mattress core 40.

Fabric layers 34 and 46 may be any fabric used as an exterior covering for a mattress, such as cotton, polyester, or any blend of materials. Fabric layers 34 and 46 may be sewn or otherwise bonded to respective cushion layers 36 and 44 to form a quilted pattern on the sleep surfaces 33 and 59. Cushion layer 36 and cushion layer 44 are substantially identical and may be similar to the mattress pads described above with respect to FIGS. 1-3. Cushion layer 36 has a padding section 52 and a first gel section 54. Cushion layer 44 has a second padding section 56 and a second gel section 58. The padding sections 52 and 56 form the peripheries of the cushion layers 36 and 44, and are infrequently used by a person during rest. As described above, the padding sections 52 and 56 may be formed from a foam, plastic, latex, visco-elastic foam, polymer, natural fiber, synthetic fiber, or any other material that may provide a cushioning effect, or a combination thereof. An aperture may be formed in padding sections 52 and 56 by cutting a padding layer or by forming, such as by molding or extruding material, the padding sections 52 and 56 around a mold having the desired shape of an aperture.

The gel sections 54 and 58 fill the aperture formed in padding sections 52 and 56 and their edges 54*a* and 58*a* abut against the inner perimeters 52*a* and 56*a* of padding sections 52 and 56, respectively. The top surfaces of the padding section 52 and gel section 54 are substantially flush with each other, as are the top surfaces of the second padding section 56 and the second gel section 58. The inner perimeter 52*a* of padding section 52 may be bonded during the curing process to edge 54*a* of gel section 54, or by other means such as for example, by heat sealing, sewing, gluing, tying, stapling, or other method. The inner perimeter 56*a* of the second padding section may likewise be bonded to the edge 58*a* of the second gel section 58. The apertures and gel sections 54 and 58 are positioned in cushion layers 36 and 44 under the areas a person generally utilizes while resting on a mattress, for example, while reading, sleeping, etc. In one embodiment, the gel sections 54 and 58 form from about 50% to about 90%, more preferably from about 60% to about 80%, of each sleep surface 33 and 39.

Although mattress 32 is depicted as having two cushion layers, layers 36 and 44, one for each sleeping surface 33 and 39, it will be understood that a mattress may include 30 one cushion layer. Further, it will be understood that additional pad layers may be included in a mattress of the present invention, that a pad layer may positioned between fabric layer 34 and cushion layer 36 instead of as illustrated, or that no pad layers are included.

Pad layers 38 and 42 may formed from a sheet of fabric, felt, or polymer, a cotton, nylon, or polyester batting, or from a layer of foam, plastic, polymer, natural fiber, synthetic fiber, or any other material or a combination thereof. Pad layers 38 and 42 may provide a cushioning effect or may cover cushion layers 36 and/or 44. In one optional embodiment, the mattress may have cover panel that comprises a non-quilted mattress cover with an optional smooth sleeping surface. In this embodiment, a multi-layer, typically three layer, crowned mattress panel may be provided over the upper surface of the mattress. For example, a crowned cover panel may be formed from a top fabric layer, an intermediate filler layer and a backing layer. Optionally, there may be a layer of flame retardant material. In either embodiment, the top layer may be a fabric layer of cotton, linen, synthetic fibers or some other material of combination of materials. To provide the proper aesthetic look, the top layer may be a flat sheet of fabric or may be a substantially flat sheet with an angled lip formed at the peripheral edge of the panel yielding a crowned appearance. The lip may be formed by cutting out a wedge of material from each corner of panel and joining the cut sections of the top layer together. The size of the lip may be from about 0.5 inches to about 7 inches in length, with the length selected depending upon the appearance desired, or the demands of the application.

The filler layer can be formed from any padding material, such as foam, cotton batting, gel, latex, visco-elastic foam or other known padding materials and or combination of padding materials. Optionally, the filler layer provides a layer of conventional filling and padding material that may be laid over the gel padding layer of the mattress. However, in other embodiments, the filler layer may itself include a foam layer that has one or more recesses formed therein, and which are filled with gel material as described above. This can provide a crowned panel of gel material that may sit over the gel padding in the mattress body. However, in another embodiment, this panel of gel material may be placed over a conventional mattress body and will thus be the only layer of gel material used in the mattress.

In either embodiment, the filler layer may have a substantially flat, smooth upper surface or may have a textured or patterned upper surface. In some embodiments, the center section of the filler layer may have a uniform height and the height may decrease at a uniform angle heading towards the panel edges. This provides an upper panel, optionally containing a layer of gel material, that gives the mattress a crowned appearance.

An optional fire resistant layer may be placed between the filler layer and the fabric layer. The fire resistant layer optionally extends over the entire upper surface of the mattress panel and around the borders of the panel. The flame resistant material may be any suitable material, such as for example KEVLAR™, PET (polyester) binder fiber, organophosphorous materials, halogenated organic materials (typically halogenated with Chlorine or more popularly Bromine) or nitrogen based compounds. Commercially available materials are sold under the trade names NOMEX, KEVLAR, INDURA and the actual material employed may depend upon the particulars of the application, including mattress type (e.g. open coil, pocketed coil, foam, water), mattress size, material costs and other such design considerations.

Under the fire resistant layer, a backing layer may be attached. The backing layer may be formed from a sheet of material, such as natural fibers such as cotton or linen, aluminum, fiberglass, synthetic fibers or a mixture thereof. These three layers may be joined together to form a crowned panel and that panel may be placed over the upper surface and joined to the mattress to provide a smooth sleeping surface.

Figure 5:
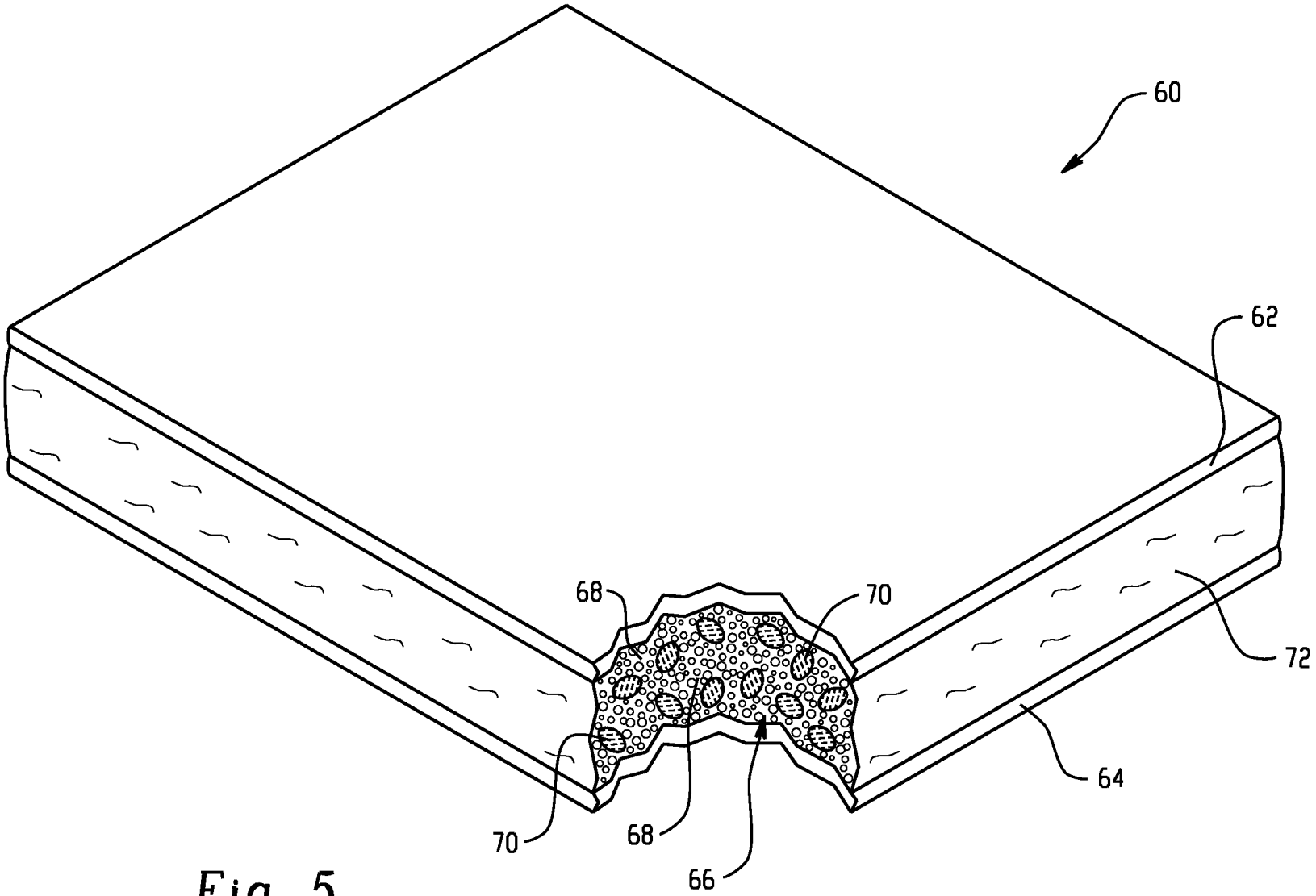
FIG. 5 depicts an exemplary mattress assembly having a mattress core including foam and gel.

In certain embodiments, as illustrated in FIGS. 5-8, the mattress core or one or more supporting layers is formed from a porous foam body and gel that are intermixed such that the gel occupies portions air pockets within the porous foam body. FIG. 5 depicts an exemplary mattress assembly 60 having a mattress core including foam and gel. More particularly, the mattress assembly 60 includes an upper support layer 62, a lower support layer 64 and a mattress core 66. The mattress assembly 60 further includes sidewalls 72 attached to the perimeter portions of the upper and lower layers 62 and 64 and along a side border region of the mattress core 66.

The mattress core 66 includes a secondary material 70 such as gel integrated with a primary material 68 such as foam. In certain embodiments, other components of the mattress assembly 60 include a combination of the primary and secondary materials 68 and 70. In such embodiments, the other components include mattress pads, mattress topper pads, one or more supporting layers above or below the mattress core and mattress covers.

In certain embodiments, the primary material 68 includes polyurethane such as foam and visco-elastic foam. The polyurethane may include a chemical combination of polyol and diisocyanate. In certain embodiments, the primary material 68 includes about 2 parts polyol and 1 part diisocyanate. The polyurethane primary material 68 includes a plurality of air pockets giving the material 68 a porous structure. In certain embodiments, the polyurethane primary material 68 has at least one of an open cell and closed cell structure. In one example of a closed cell structure, the polyurethane material is chemically cross-linked and the air pockets or gas filled voids are disposed internally within the polyurethane foam body and have minimal contact with the exterior surface of the body. In one example of an open cell structure, the air pockets are disposed internally within the polyurethane foam body and extend through one or more surfaces. In certain embodiments, the porosity and/or the density of the primary material 68 determines the volume of space occupied by the plurality of air pockets. In certain embodiments, low porosity materials have fewer air pockets than high porosity materials. The level of porosity and/or the number of air pockets may be selected as desired. In certain embodiments, the number of air pockets is increased through one or more reticulation processes as described in further detail in FIGS. 7 and 8.

In certain embodiments, the mattress core 66 has a body made from the primary material 68 and infused with the secondary material 70 such that the secondary material 70 is distributed throughout the interior of the primary material 68 as described with reference to FIG. 6. In certain embodiments, the secondary material 70 includes any suitable elastomer without departing from the scope of the invention. In certain embodiments, the secondary material 70 includes latex. The secondary material 70 may include a polyurethane based gel. The gel may include a chemical combination of polyol and diisocyanate. In certain embodiments, the gel includes about 10 parts polyol and 1 part diisocyanate. Exemplary gel materials may include LEVAGEL™ or TECHNOGEL™ made by Technogel Italia Srl, Pozzoleone (VI) Italy, and polyurethane and elastomeric materials manufactured by Dow Chemical Company, Midland, Mich., USA. The secondary material 70 may include polymer material, such as thermoset elastomer and other polymeric materials described in U.S. Pat. Nos. 5,362,834, 6,326,412 and 6,809,143, the entire contents of which are herein incorporated by reference. In certain embodiments, the gel includes, at least one of silicone gel, a PVC gel, a polyorganosiloxane gel, a NCO-prepolymer gel, a polylol gel, a polyurethane gel, a polyisocyanate gel, and a gel including a pyrogenically produced oxide. The gel may be in a solid state or a liquid state. In certain embodiments, the gel may transition from liquid to a solid state on applying heat or pressure.

In certain embodiments, the secondary material 70 fills one or more of the plurality of air pockets within the primary material 68. In certain embodiments, the air pockets are substantially uniformly located throughout the interior of the primary material 68 and the secondary material 70 fills these pockets and is substantially uniformly distributed throughout the interior of the mattress core 66. In certain embodiments, the secondary material 70 integrates with the primary material 68 through chemical bonding. In such embodiments, the secondary material 70 is initially in liquid form and combined with the primary material 68. During curing or hardening, the secondary material 70 may establish a chemical bond with the primary material.

Figure 6:
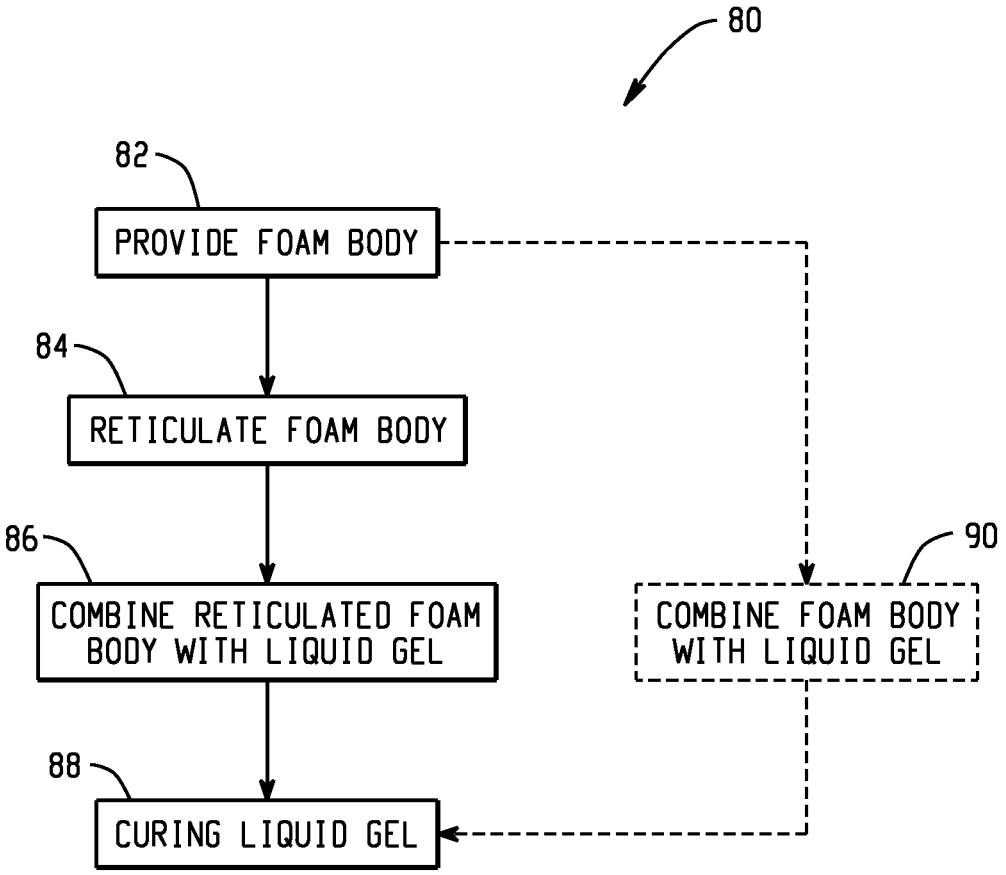
FIG. 6 is a flow diagram depicting an exemplary process for manufacturing a 15 mattress component.

FIG. 6 is a flow diagram depicting an exemplary process 80 for manufacturing a mattress component. The process 80 begins with providing a foam body or a body made from any primary material 68 (step 82). The foam body is then reticulated to increase the volume and/or the number of air pockets (step 84). The reticulated foam body is then combined with a liquid gel or any secondary material 70 (step 86). In certain embodiments, the foam body from step 82 is combined with the secondary material 70 or liquid gel. In certain embodiments, the foam body or the reticulated foam body is dipped into a tub or vessel containing the secondary material 70 or gel in liquid form. The gel is allowed to seep into the body thereby filling one or more of a plurality of air pockets. In other embodiments, the gel is poured over the foam or reticulated foam body to infuse the gel into the air pockets. The liquid gel infused into the body is allowed to harden through a curing process (step 88). In certain embodiments, the curing process may be stimulated through the application of heat and/or pressure.

Figure 7:
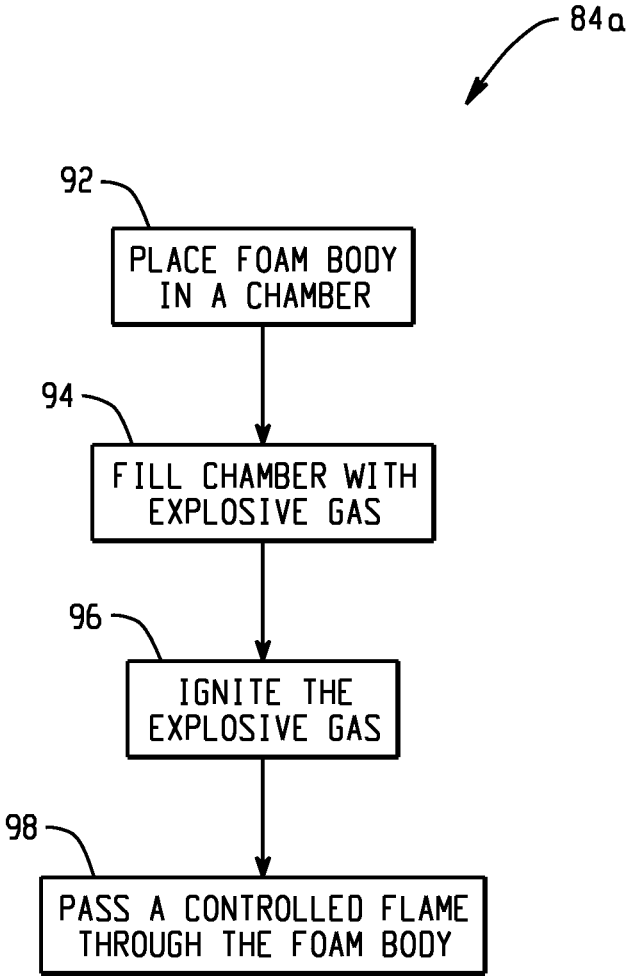
FIG. 7 is a flow diagram depicting an exemplary process for reticulating a foam body.

The foam body may be reticulated through at least one of a thermal process and a chemical process. FIG. 7 is a flow diagram depicting an exemplary thermal process 84*a* for reticulating a foam body. The process 84*a* begins with placing and enclosing the foam body in a chamber or vessel (step 92). The chamber is filled with explosive gas such as hydrogen and oxygen (step 94). In certain embodiments, the chamber is evacuated prior to filling with the explosive gas. The explosive gas is ignited through an electric spark or a controlled flame (step 96), thereby forming a one or more air pockets within the foam body. In certain embodiments, a controlled flame is passed through the foam body to remove certain portions of the body and thereby create one or more air pockets in those desired regions (step 98).

Figure 8:
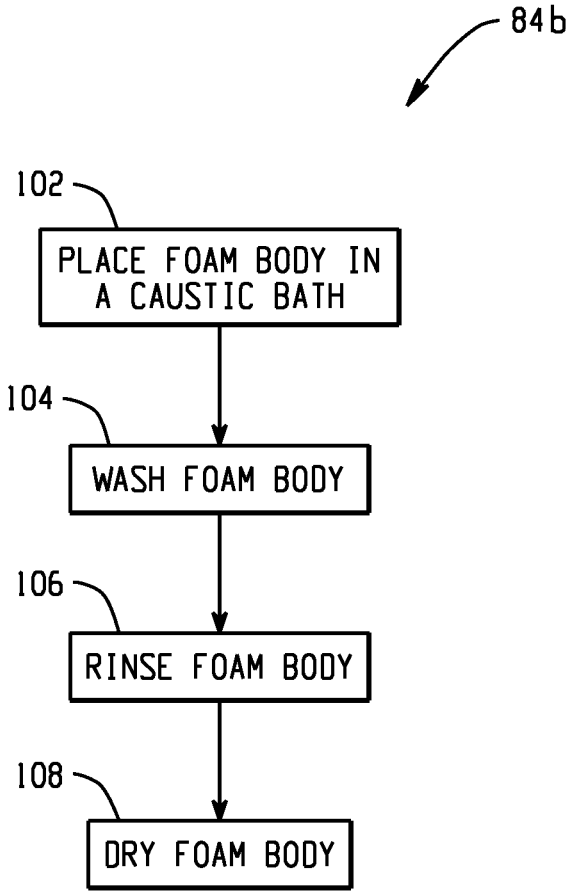
FIG. 8 is a flow diagram depicting an exemplary process for reticulating a foam body.

FIG. 8 is a flow diagram depicting an exemplary chemical process 84*b* for reticulating a foam body. The process 84*a* begins with placing the foam body in a caustic bath (step 102). In certain embodiments, the caustic bath includes a vessel containing a NaOH solution. The foam body may be allowed to sit in the caustic bath for any duration of time as desired. In certain embodiments, the caustic solution reacts with the foam and removes the foam material from the body, thereby generating a plurality of voids. The foam body is removed from the caustic bath and washed (step 104), rinsed (step 106) and dried (step 108).

While this invention has been described in specific detail with reference to the disclosed embodiments, it will be understood that many variations and modifications may be effected within the spirit and scope of the invention as described in the appended claims. For example, the mattress may include a foam core, or a combination of foam and springs. The mattress may be one-sided or two-sided. Consequently, those skilled in the art will know or be able to ascertain using no more than routine experimentation, many equivalents 25 to the embodiments and practices described herein. Accordingly, it will be understood that the invention is not to be limited to the embodiments disclosed herein, but is to be understood from the following claims, which are to be interpreted as broadly as allowed under the law.

What is claimed is:

1. A foam mattress assembly, comprising:

a mattress pad positioned atop a mattress and a foundation, the mattress pad being removably attached to the mattress comprising:

at least one foam support layer comprising a first zone having a convoluted foam surface positioned to support an end user's neck and shoulders, a second zone including a recess positioned to support an end user's lumbar region, wherein the recess is defined by perimeter foam walls extending about the recess in its entirety and a foam bottom surface and at least one additional zone positioned to support an end user's lower legs having a convoluted and/or a smooth foam surface, and wherein top surfaces of the smooth surfaces and the convoluted surfaces are substantially flush relative to one another;

an unpackaged gel section filling the recess in the at least one foam support layer, wherein the gel section is integrally formed within the recess and self-adhered to the perimeter foam walls and the bottom foam surface of the recess in the at least one foam support layer, wherein the gel section comprises a dimensionally stable gel and a plastic film over the dimensionally stable gel, wherein the dimensionally stable gel is a single gel selected from the group consisting of a silicone gel, a PVC gel, a polyorganosiloxane gel, a polyol gel, a polyisocyanate gel, and a gel including a pyrogenically produced oxide; and a cover encapsulating the at least one foam support layer and the gel section.

2. A two-sided mattress assembly, the two-sided mattress assembly comprising:

at least one foam support layer above a mattress core abutting a first sleeping surface on a first side of the mattress assembly, the at least one foam support layer above the mattress core comprising a first zone having a convoluted foam surface, a second zone including a first aperture, wherein the first aperture is defined by perimeter foam walls extending about the first aperture in its entirety, and at least one additional zone having a convoluted and/or a smooth foam surface, and wherein top surfaces of the smooth surfaces and the convoluted surfaces are substantially flush relative to one another;

a gel section in the aperture of the at least one foam support layer above the mattress core, the gel section is integrally formed within the aperture and self-adhered to the perimeter foam walls of the at least one foam support layer, wherein the gel section comprises a dimensionally stable gel and a plastic film over the dimensionally stable gel, wherein the dimensionally stable gel is a single gel selected from the group consisting of a silicone gel, a PVC gel, a polyorganosiloxane gel, a polyol gel, a polyisocyanate gel, and a gel including a pyrogenically produced oxide; and at least one foam support layer below the mattress core abutting a second sleeping surface on a second side of the mattress assembly, the at least one foam support layer below the mattress core comprising a first zone having a convoluted foam surface, a second zone including a second aperture, wherein the second aperture is defined by perimeter foam walls extending about the second aperture in its entirety and at least one additional zone having a convoluted and/or a smooth foam surface, and wherein top surfaces of the smooth surfaces and the convoluted surfaces are substantially flush relative to one another; a gel section in the aperture and self-adhered to the perimeter foam walls of the at least one foam support layer below the mattress core, wherein the gel section is a dimensionally stable gel intermixed with a foam body, wherein the dimensionally stable gel is a single gel selected from the group consisting of a silicone gel, a PVC gel, a polyorganosiloxane gel, a polyol gel, a polyisocyanate gel, and a gel including a pyrogenically produced oxide, wherein the mattress core is intermediate the at least one foam support layer above and the at least one foam support layer below the mattress core.

* * * * *